United States Patent [19]

Ward et al.

[11] 4,082,500

[45] Apr. 4, 1978

[54] PROCESS FOR IMPARTING WRINKLE RECOVERY TO COTTON FABRICS WITH VAPORS FROM GLYCIDOL

[75] Inventors: Truman L. Ward; Ruth R. Benerito, both of New Orleans, La.

[73] Assignee: The United States of America as represented by the Secretary of Agriculture, Washington, D.C.

[21] Appl. No.: 794,595

[22] Filed: May 6, 1977

[51] Int. Cl.[2] ..... D06M 13/00; D06M 1/00

[52] U.S. Cl. ..... 8/120; 8/116 R; 8/129; 8/181; 8/DIG. 11; 8/196

[58] Field of Search ..... 8/120, 116 R, 196, DIG. 11, 8/129

[56] References Cited

U.S. PATENT DOCUMENTS

| | | | |
|---|---|---|---|
| 3,811,834 | 5/1974 | Schwemmer et al. | 8/116 R |
| 3,963,435 | 6/1976 | Ward et al. | 8/120 |

OTHER PUBLICATIONS

Ward; T. L., and Benerito; R. R., J. of Applied Polymer Science, 1977, 21, 1933–1944.

Soignet; D. M. et al., J. Applied Polymer Science, 1967, 11, 1155–1172.

*Primary Examiner*—A. Lionel Clingman

*Attorney, Agent, or Firm*—M. Howard Silverstein; David G. McConnell; Sal J. Cangemi

[57] ABSTRACT

Certain chemically modified cotton fabrics have been treated with vapors of glycidol at reduced pressures in a heated chamber to impart improved wet and dry wrinkle recovery characteristics.

10 Claims, No Drawings

PROCESS FOR IMPARTING WRINKLE RECOVERY TO COTTON FABRICS WITH VAPORS FROM GLYCIDOL

BACKGROUND OF THE INVENTION (1) Field of the Invention

This invention relates to treatment of fibrous cellulosic material with chemical vapors of glycidol or chemicals that produce glycidol. More specifically, this invention relates to the treatment of carboxymethylated (CM-) or diethylaminoethylated (DEAE-) cotton with vapors of glycidol to obtain improved conditioned (dry) and wet wrinkle recoveries.

(2) Description of the Prior Art

In the prior art, both wet and conditioned states of cellulosic fabrics, such as cotton, have been improved by reaction with compounds which release formaldehyde (Ref. E. J. Gonzales, et al., American Dyestuff Reporter 54, 105–108 [1965]) and with compounds such as diepoxides and epichlorohydrin (Ref. T. Francis, et al., Textile Research Journal 33 [8], 583–599 [1963], and G. R. Ferrante, Textile Research Journal 35 (5), 446–452 [1965]).

In the prior art the reagent in the vapor state has been used with an added catalyst. In addition, the reagents used to produce wrinkle recovery in cotton are irritating, toxic, and in the case of epichlorohydrin, can result in explosive mixtures with cotton amine catalysts (Ref. J. C. Williams, Chemistry & Industry 28, page 994 [1971]). The difunctional epoxide reagents used thus far in the prior art of vapor phase applications result in increased wet recovery in cotton but little improvement in dry or conditioned recovery. The prior art teaches that monofunctional epoxides, that is, monoepoxides, even those such as ethylene oxide, which is a gas at room temperature, do not produce wet and dry crease recovery in cotton (Ref. J. B. McKelvey, "Cotton Modification with Oxiranes (Epoxides," Merrow Publishing Co., Ltd., Watford, Herts, England, pages 1–42 [1971]).

While epichlorohydrin is, in the strict sense, a monoepoxide, it contains a labile halogen which makes it difunctional in the usual base-catalyzed reactions reported in the prior art. It does not react with cellulose in the presence of acids under safe or practical conditions of temperature and pressure. When epichlorohydrin does react with cotton, it raises the wet recovery substantially, but it only raises the dry recovery slightly, if at all. Also, in prior art, glycidol, a true monoepoxide, has been reacted with cotton using external base catalysis, but only the wet wrinkle recovery was improved (Ref. J. B. McKelvey, "Cotton Modification with Oxiranes (Epoxides)," Merrow Publishing Co., Ltd., Watford, Herts, England, pages 1–42 [1971]). In prior art diethylaminoethylated cotton fabric (DEAE-cotton) has been reacted with several epoxides, but the reactions with monoepoxides did not improve the dry wrinkle recovery. Also in the prior art, ethylene carbonate and propylene carbonate have been used as the liquid for improving wrinkle recovery. Glycerine carbonate as the liquid was not included in that aspect of the prior art because although also a cyclic carbonate, it reacts differently to the aforementioned two.

SUMMARY OF THE INVENTION

Wet and dry wrinkle recovery of fibrous cellulosic fabrics are improved by reacting carboxymethyl- or diethylaminoethyl- modified cellulosic fibers with glycidol vapor.

The products of this invention contain crosslinks of 3 carbon chain lengths that covalently link two carboxyl groups of the CM-cottons or two amino groups of the DEAE-cottons to impart wrinkle recovery and insolubility in cellulose solvents to the fabrics.

Since the recovery from wrinkling in both the wet and the dry state is of concern to the instant invention the primary object is to provide a process for improving the wrinkle recovery in both wet and dry state of cotton fabric.

A second object is to provide a process for treating carboxymethylated cotton (prepared by any process) or ethylaminoethylated cotton so that the wrinkle recovery will be improved.

A further object is to react glycidol with CM- or DEAE-modified cellulosic fibers in the absence of added catalysts.

DETAILED DESCRIPTION OF THE INVENTION

In the preferred practice of the present invention, glycidol vapor is generated by heating glycerine carbonate at reduced pressure. Glycerine carbonate can be generated by heating a mixture of propylene carbonate and glycerol. The monoepoxide glycidol may react with either carboxyl or diethylaminoethyl groups attached to the cellulose and form crosslinks between cellulose chains. The resultant improved wet and dry wrinkle recovery is unexpected from reaction between cellulosic fabric and monoepoxides.

The following reaction schemes are included for purposes of clarification only.

(1) Glycidol can be formed as follows from glycerine carbonate:

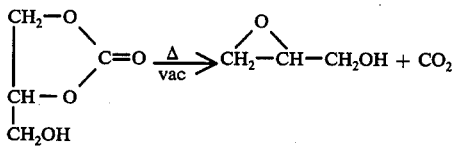

(2) Glycidol can also be formed as follows by heating a mixture of propylene carbonate and glycerol:

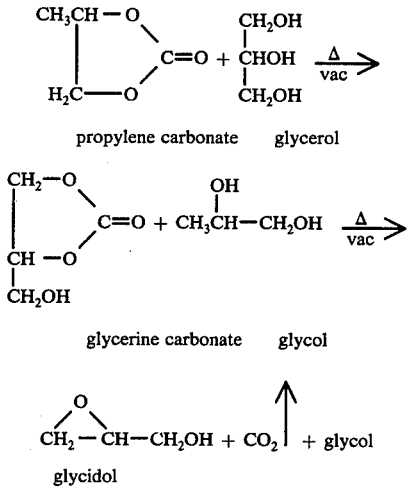

(3) A proposed scheme for the glycidol-carboxymethylated cotton reaction is as follows:

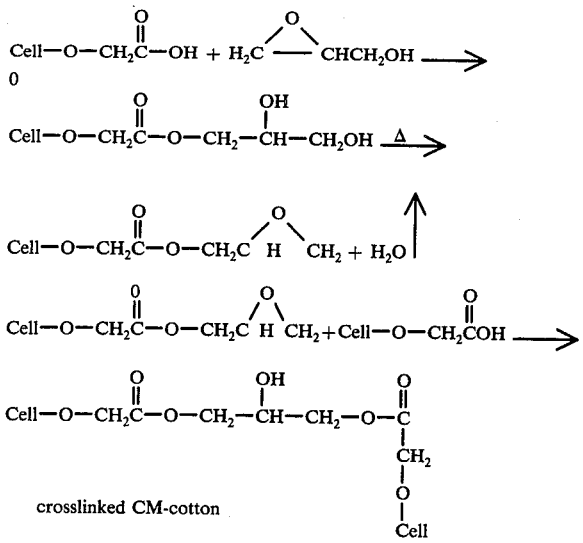

(4) A proposed scheme for the glycidol-DEAE-cotton reaction is as follows:

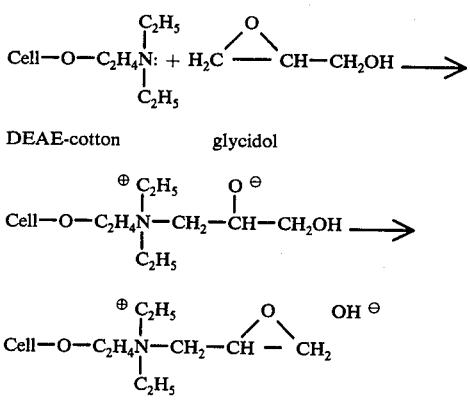

Note:
The terminal oxirane ring would be free to subsequently react with another reactive group of cotton to give crosslinked DEAE-cotton.

With reference to glycidol it must be emphasized that it is an unstable reactive compound, which is usually kept in a refrigerator. Glycidol vapors can constitute a health hazard. The instant invention avoids the hazards and problems by generating and/or using the reactive glycidol inside a closed system. The instant invention includes the discovery that the acids or basic groups of CM-cotton or DEAE-cotton impel the reaction between the vapors and modified cotton without the need of an added acid or base catalyzing agent.

When the modified cellulosic fabric starting material contains carboxymethylated cotton the end product of the present invention is the carboxymethylcellulose diester of glycerol.

The nature of the product when an acid ester is formed can be verified by hydrolyzing the product to convert back to the starting materials.

When the modified cellulosic fabric starting material contains diethylaminoethylated cotton the end product can be either a mono- or a di-quaternary ammonium salt of diethylaminoethyl cellulose.

The nature of the product when the amine salt is formed can best be determined by titration of the ammonium salt to verify the quaternary.

In all cases microscopic examination of cross sections of the product fibers by expanding and embedding them in methacrylate serve to confirm the presence and location of crosslinks or grafted monomeric units. Solubility characteristics in cupriethylendiamine also verify the reaction. Crosslinked cellulosic materials are insoluble in cupriethylenediamine.

Although various combinations of vacuum and temperature may be employed for the generation of glycidol vapor, a vacuum of about 35 mm Hg works well with a temperature of about 180°–200° C. Such a temperature causes adequate decomposition of glycerine carbonate to glycidol without excess formation of undesirable products such as polyols.

After generation of the glycidol vapor, it is conveyed, within the closed system, to the primary reaction chamber containing the CM- or DEAE-modified cellulosic fibers. The reaction chamber preferably is heated to about 160°–180° C, and is maintained under reduced pressure, e.g., about 35 mm Hg vacuum. Such temperatures propel the desired reaction without serious damage to the fabric, while the reduced pressure promotes the desired reaction at these temperatures and removes byproduct water vapor from the reaction chamber.

In accordance with the practice of this invention, the cellulosic fabric is modified with CM or DEAE groups in the well known prior art manner, either by means of aqueous or non-aqueous procedures. The D.S. (degree of substitution) of CM-cotton will be in the range of about 0.1 to 0.3. Nitrogen content of DEAE-cotton will be in the range of 0.5% to 1.5%. Although these are the preferred ranges of values, substantially any D.S. can produce favorable changes in wrinkle recovery values.

While 80 × 80 cotton printcloth is the weight and weave used in the examples, other weaves and cellulosics from sources other than cotton used above or in blends with synthetic fibers can be modified to produce carboxymethylated or diethylaminoethylated cellulosic fabric for use as starting material.

The amount of glycerine contained in the glycidol-generation chamber will vary with the amount of sample treated and the length of time treated, but 50 to 100 ml is usually adequate. From 1 to 3 hours is sufficient reaction time.

The following examples serve to illustrate certain details of the invention and not to limit the invention.

EXAMPLE 1

(Preferred procedure)

Diethylaminoethylated cotton fabric which had been prepared from 80 × 80 cotton printcloth and which had a nitrogen content of 0.8% was placed in a vacuum oven preheated to and maintained at 160° C. Connected to the vacuum oven by a short length of vacuum tubing was a flask containing 50 ml of glycerine carbonate. Connected to the opposite side of the vacuum oven was a vacuum source complete with trap. The entire system was immediately closed and evacuated to approximately 35 mm of Hg pressure where it was maintained during the reaction. The flask containing the glycerine carbonate was heated to about 180° C and maintained there during the course of the reaction. Reaction was timed beginning when the temperature of the glycerine carbonate reached 180° C. Reaction was continued for 2 hours. At end of reaction all heating was stopped, the vacuum was released, the sample was removed, was thoroughly washed with water and dried prior to testing. Wet and dry (conditioned) wrinkle recovery angles (W+F°) as measured by a standard ASTM procedure increased from 206 wet and 152 dry to 274 wet and 246 dry. The wrinkle recovery values of unmodified cotton control and of aminoethylated cotton fabrics were unchanged. Aminoethylated cotton with its primary amine structure was used to show that the tertiary amine groups will work when others will not.

EXAMPLE 2

The technique of Example 1 was employed except that carboxymethylated cotton with a degree of substitution of 0.1 was substituted for diethylaminoethylated cotton. Wet wrinkle recovery was increased from 214 to 223 and conditioned (dry) recovery was increased from 227 to 245.

EXAMPLE 3

The technique of Example 1 was employed except that dietholaminoethylated cotton with a nitrogen content of 1.2% was substituted for diethylaminoethylated cotton with a nitrogen content of 0.8%. Wet wrinkle recovery was increased from 204 to 280 and dry recovery was increased from 170 dry to 262.

EXAMPLE 4

The technique of Example 2 was employed except that a carboxymethylated cotton with a degree of substitution of 0.3 was used in place of the carboxymethylated cotton having a degree of substitution of 0.1. Wet wrinkle recovery was increased from 215 to 235 and conditioned (dry) recovery was increased from 230 to 253.

We claim:

1. A process for imparting improved wet and dry wrinkle recovery to fabric containing cellulosic fibers comprising (a) modifying said fibers with diethylaminoethyl or carboxymethyl groups, and thereafter (b) reacting said groups with glycidol vapor to form crosslinks between said carboxymethyl groups or between said diethylaminoethyl groups.

2. The process of claim 1 wherein said reaction is carried out at about 160°–180° C.

3. The process of claim 1 wherein said vapor is generated by heating glycerine carbonate.

4. The process of claim 1 wherein said vapor is generated by heating a mixture of propylene carbonate and glycerol.

5. The process of claim 1 wherein said reaction is carried out at reduced pressure.

6. The process of claim 2 wherein said vapor is generated by heating glycerine carbonate.

7. The process of claim 2 wherein said vapor is generated by heating a mixture of propylene carbonate and glycerol.

8. The process of claim 2 wherein said reaction is carried out at reduced pressure.

9. The process of claim 3 wherein said vapor is generated at reduced pressure, and at a temperature of about 180°–200° C.

10. The process of claim 9 wherein said reaction with glycidol vapor is carried out under reduced pressure and at a temperature of about 160°–180° C and wherein said reaction and said step of vapor generation are carried out within a closed system.

* * * * *